US006123335A

United States Patent [19]

Adkins

[11] Patent Number: 6,123,335

[45] Date of Patent: Sep. 26, 2000

[54] METHOD OF PLAYING A CASINO GAME

[76] Inventor: Daniel Adkins, 3317 Arthur St., Hollywood, Fla. 33021

[21] Appl. No.: 09/094,989

[22] Filed: Jun. 15, 1998

[51] Int. Cl.[7] ..... A63F 1/00

[52] U.S. Cl. ..... 273/292; 273/274; 463/22; 463/12

[58] Field of Search ..... 273/292, 309, 273/274; 463/22, 12

[56] References Cited

U.S. PATENT DOCUMENTS

| | | | |
|---|---|---|---|
| 4,648,602 | 3/1987 | Maroney | 273/146 |
| 5,350,175 | 9/1994 | DiLullo et al. | 273/146 |
| 5,397,128 | 3/1995 | Hesse et al. | 273/292 |
| 5,407,208 | 4/1995 | Keller et al. | 273/274 |
| 5,431,407 | 7/1995 | Hofberg et al. | 273/292 |
| 5,513,850 | 5/1996 | Vancura | 273/274 |
| 5,632,485 | 5/1997 | Woodland et al. | 273/292 |
| 5,690,337 | 11/1997 | Somma et al. | 273/309 |
| 5,718,429 | 2/1998 | Keller, Jr. | 273/274 |
| 5,718,431 | 2/1998 | Ornstein | 273/292 |
| 5,720,484 | 2/1998 | Hsu | 273/292 |
| 5,842,698 | 12/1998 | Brown | 273/292 |

*Primary Examiner*—Benjamin H. Layno

*Attorney, Agent, or Firm*—Malloy & Malloy, P.A.

[57] ABSTRACT

A casino type game and method of playing the game structured to be played either manually, or electronically, incorporating video display facilities and a controlling central processing unit. Preferably, the game is played by a method incorporating manual and electronic steps at least to the extent that the features associated with the card game of 21 are played manually using one or more conventional decks of cards and of a dealer physically dealing the cards to each of a plurality of participating players. The game stages associated with the preferred features of the dice game craps are preferably played electronically through the replication of a plurality of dice rolls and the video display or depiction of such dice rolls to determine a resulting number that defines a basis of continued play. Further, the game is played to include a series of game stages, a first of which provides for bets to be placed and an initial dice roll to be made to achieve a resultant number, a second of which provides for the dealing of a hand of cards to the player and dealer and continuing with the player receiving additional cards or adding the resulting number from the first dice roll to achieve a final number count to be compared with the dealer's final number count in a conventional manner associated with the game of 21. Lastly, a third stage is completed wherein side bets are made and further rolls of the dice are completed in accordance with the rules of craps.

16 Claims, 3 Drawing Sheets

METHOD OF PLAYING A CASINO GAME

BACKGROUND OF THE INVENTION

1. Field of the Invention

This invention relates to a game and a method of play primarily, but not exclusively designed for a casino or gaming house environment which incorporates preferred features of the card game of "21" as well as the dice game of "craps" in order to offer the wide variety of players an exciting, fast paced source of gambling action which is relatively simple.

2. Description of the Related Art

Casinos and like gaming houses are finding it increasingly difficult to encourage and develop new "table games" which are attractive to a large number of players regardless of their economical level of play. It is generally well accepted that today's high tech world has created a new breed of casino players which are becoming increasingly dissatisfied with conventional casino card games and dice games requiring manual play. The modern day casino player, being exposed continuously to the proliferation of video gaming devices, appears to be searching for more exciting games played at a faster pace which are uncomplicated and accordingly easier to understand. The existence of such a wide variety of video gaming devices is a perfect example of how advances into electronic and video technology have penetrated the casino market in attempt to fill the needs of the modern day player that is not satisfied with the relatively slow play of conventional table games as set forth above. In addition, video and/or electronically controlled or activated games are also generally advantageous to the casino operators in that such high tech games or devices require far less operational overhead as compared to most conventional casino table games.

In an effort to overcome the disadvantages of the type set forth above, and to satisfy modern day casino players interested in high tech or electronic versions of conventional casino games, a variety of video gaming devices are available to players. Such devices include slot machines and other video type games which are exciting when a player realizes a payoff or "jackpot". However, such jackpot payoffs are relatively infrequent and accordingly cannot match the excitement of some casino table dice games such as craps especially when a player realizes or demonstrates a plurality of successful dice rolls. The card game of "21" or "blackjack" while not generally providing the demonstrative excitement of a game of craps does allow the experienced or knowledgeable player a better chance of winning because of certain instances of favorable odds swinging to the player. The primary disadvantage or reason why blackjack does not enjoy increasing popularity is the relatively low payout, frequently averaging a maximum of 1.5 times a player's initial wager.

Based on the above, there is a need in the gaming industry for a new modified game which is capable of at least partially being played electronically using pre-programmed or processor controlled video facilities which combine the excitement and attractive features of a dice game of craps with the statistical advantages available by incorporating certain preferred features of the card game of 21 or blackjack. A resulting modified game would be specifically adaptable to a casino or gaming house environment and would have a fast pace, resulting in higher payout to winning players. In addition, such a preferred modified game and method of play could also incorporate features and facilities for teaching the basic fundamentals of the dice game of craps or the card game of blackjack to new players without risking the intimidation a player may face at a conventional gaming table dedicated to conventional method of playing such games.

SUMMARY OF THE INVENTION

The present invention is directed towards a game and method of play which combines certain preferred features of the card game of 21 with additional preferred features of the dice game of craps in a unique and novel manner structured to maximize the entertainment and enjoyment of the game. The game is specifically designed to be played either all or part manually and/or all or part electronically, but in a preferred embodiment the method of play involves a combination of manual and electronic play. While the electronic version offers the added feature of a certain amount of visual excitement to the play, the manual version incorporates an actual "feel" for the game such as when one or more players are involved with the physical roll of the dice.

Under the conventional rules of the card game of 21, the goal of each player is to achieve a hand which has a final number count closer to 21 than the final number count of the hand of a dealer. Each participating player places an initial wager and accordingly receives a first two cards. The dealer also receives a first two cards wherein each card dealt both to the players and the dealer contributes to the final number count of a player's hand in accordance with its face value. The exception being that all face cards count as 10 and an ace may count as either 1 or 11. In establishing the final number count and attempting to come as close to 21 as possible without exceeding that number, both the players and the dealer are allowed to "stand" on the number count of their first two cards or receive additional cards in an effort to raise the final number count. When the dealer or any of the players decide to take additional cards for purposes of increasing the final number count of their respective hands, such player and/or dealer "busts" if the resulting final number count exceeds 21. Further, any player's hand or dealer's hand that "busts" is considered to be a losing hand and is removed from consideration in the further play of the game. Other variations are normally found and accepted under what may be considered the conventional rules of casino 21 and such variations may be incorporated in the play of the modified game of the present invention.

The conventional rules associated with the casino play of the dice game of craps involves utilization of a substantially large, elongated "craps table" having an exposed playing surface surrounded by a retaining wall or like structure. The exposed playing surface is specifically structured to allow the manual role or "throwing" of dice along the length thereof wherein the dice, once thrown, are restricted from falling off the playing surface by the existence of the aforementioned retaining wall. The playing surface includes a plurality of surface segments at least partially segregated from one another. Each of the plurality of surface segments are designated with certain indicia representative of numbers and/or categories for the placement of the initial wagers (pass line) and/or situational wagers such as but not limited to point or number bets, field bets, hard number bets, come bets, and no come bets. In the conventional method of play, each player positioned around the exterior periphery of the gaming table is allowed to manually roll the dice or become a "shooter". Further, each of the plurality of participating players are given the opportunity of placing an initial wager on the "pass line". The performance of a pass line wager indicates that the player was betting that the initial or "come out" roll of dice will fall within a first predetermined number grouping defined by the numbers 7 or 11. Further, if the first roll of dice provides a resulting number within a second predetermined number grouping defined by the numbers 2, 3 or 12, the player "craps out" and all players lose their initial "pass line" wager. If, however, the resulting number of the first roll of dice falls within a third predetermined number grouping of 4, 5, 6, 8, 9 or 10 a "point" is established which is defined by a total number count of the dice roll. Conventional rules of the game of craps calls for the "shooter" to continue repeated rolls of the dice in order to determine repeated resulting numbers therefrom. With the second and/or subsequent rolls of the dice all players having wagers on the pass line will be paid if the shooter reaches the resulting number equal to the "point" number before reaching the resulting number of 7.

As set forth above, the game of the present invention, including the preferred method of play, combines the certain, preferred features of both the card game 21 and the dice game craps and is specifically designed to play the game manually, electronically or both. Specifically, the modified game of the present invention incorporates a game assembly including a table or other structure incorporating an exposed playing surface. The playing surface includes a plurality of player positions as well as certain playing surface segments at least partially segregated from one another and specifically delineated to indicate receipt and/or placement of certain initial wagers and/or situational wagers consistent with the conventional rules of the dice game of craps as generally set forth above. The playing surface includes a dealer position and sufficient area and accessibility for the dealer to deal each participating player a plurality of cards in accordance with the conventional rules of the card game of 21. The exposed playing surface may also include sufficient area for the performance of a plurality of manually performed dice rolls wherein the dice are allowed to travel on the exposed playing surface.

In addition to the above, the modified casino game of the present invention may further include certain facilities, incorporating certain technology related to the utilization of a preprogrammed central processing unit (CPU). The CPU includes a database assembly preprogrammed and inputted with individualized software capabilities at least capable of tracking a basic game of the dice game craps including certain predetermined, conventional rules thereof as generally set forth above.

The aforementioned database assembly may further include capabilities to which the central processing unit is responsive, for the display, through the provision of a video display facility, of graphics designed to add flare and excitement to the game. The central processing unit and video display facilities are capable of electronically depicting a plurality of dice rolls once activated by an appropriately structured activation assembly. The activation assembly in turn may be controlled by any one or all of the players, on an individual bases, to create a first dice roll or any subsequent dice rolls, in accordance with the conventional rules of the game of craps, as will be explained in greater detail hereinafter.

By way of example, a preferred method of play of the modified game of the present invention begins with each participating player placing a wager in a first surface segment on the playing surface designated as a betting area with the visually observable indicia "pass line". One of the participating players is then designated as the "shooter" and performs a first dice roll. In one embodiment of the present invention the dice roll may be performed manually by literally throwing a pair of dice across the area of the playing surface designated to receive such manual dice roll. Alternately and in a preferred embodiment of the present invention the "shooter" player presses a "roll" button which in turn is connected to and serves to operate the activation assembly. The activation assembly serves to activate the central processing unit which accesses the database assembly and electronically depicts, through cooperative structuring with the video display a dice roll appearing thereon. The video display may show a highly graphic pair of dice rolling forward and becoming larger, eventually stopping to display the outcome of the dice roll in the form of a resulting number. Utilizing the conventional rules of craps, the players are then paid off in accordance with the resulting number achieved by the first dice roll.

A second game stage continues at this point of play by a hand, comprising a first two cards, being dealt to each player as well as the dealer. The second game stage continues by substantially following the conventional rules of the card game of 21 in allowing each player to determine the final number count of his hand. The exception to this is that each player has the option of determining the final number count of his or her hand by using the resulting number determined at the end of the first dice roll. If this option is chosen, the resulting number is added to the number count of the first two cards received in the deal and the final number count is achieved for comparison with the dealer's final number count. The dealer is never allowed to use the resulting number of the first dice roll in determining the final number count of his/her hand. He must proceed with the substantially conventional rules of the card game of 21 in determining the final number count of the dealer's hand. This second game stage comes to a conclusion by paying winnings to all winning players holding a winning "21" hand. Such winning players of the second game stage have the option of removing their winnings or adding their winnings, plus additional amounts, if desired, to their original pass line bet. It should be noted that the original pass line bet cannot be removed during the first game stage or second game stage until the designated "shooter" has rolled the dice at least once following the come out roll.

After completion of the second game stage, a third game stage begins by providing each participating player the opportunity of making situational bets, generally in accordance with the conventional rules of the dice game of craps. Such situational bets include point number bets, field bets, hard way number bets, come bets, don't come bets, etc. The third game stage is concluded by permitting the player designated as the "shooter" to again perform one or more continuous rolls either electronically or manually in the manner set forth above. Such rolls continue until the original "point number" is made or until the resulting number of the last previous roll is a 7.

It is a primary object of the present invention to provide a modified game and method of play which incorporate preferred features of the card game of 21 and preferred features of the dice game of craps.

Another primary object of the present invention is to provide a modified casino type game incorporating features of both a conventional card game and conventional dice game which may be played manually, electronically or utilizing a combination of both manual and electronic play.

Yet another important object of the present invention is to provide a modified game and method of play which adds excitement and increases the pace of play in order to attract modern day players.

Still another important object of the present invention is to provide a modified game and method of play specifically adapted for casino or any establishment where a large number of players can simultaneously enjoy the added excitement of play as well as the variable odds of certain playing situations.

It is also an important object of the present invention to provide a modified game and method of play which are advantageous to casino operators by requiring less operational overhead as compared to most conventional casino type games.

Yet another important object of the present invention is to provide a modified game and method of play which provides additional excitement as well as increased amounts of winnings and is thereby attractive to a wide variety of players of various social economic levels.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
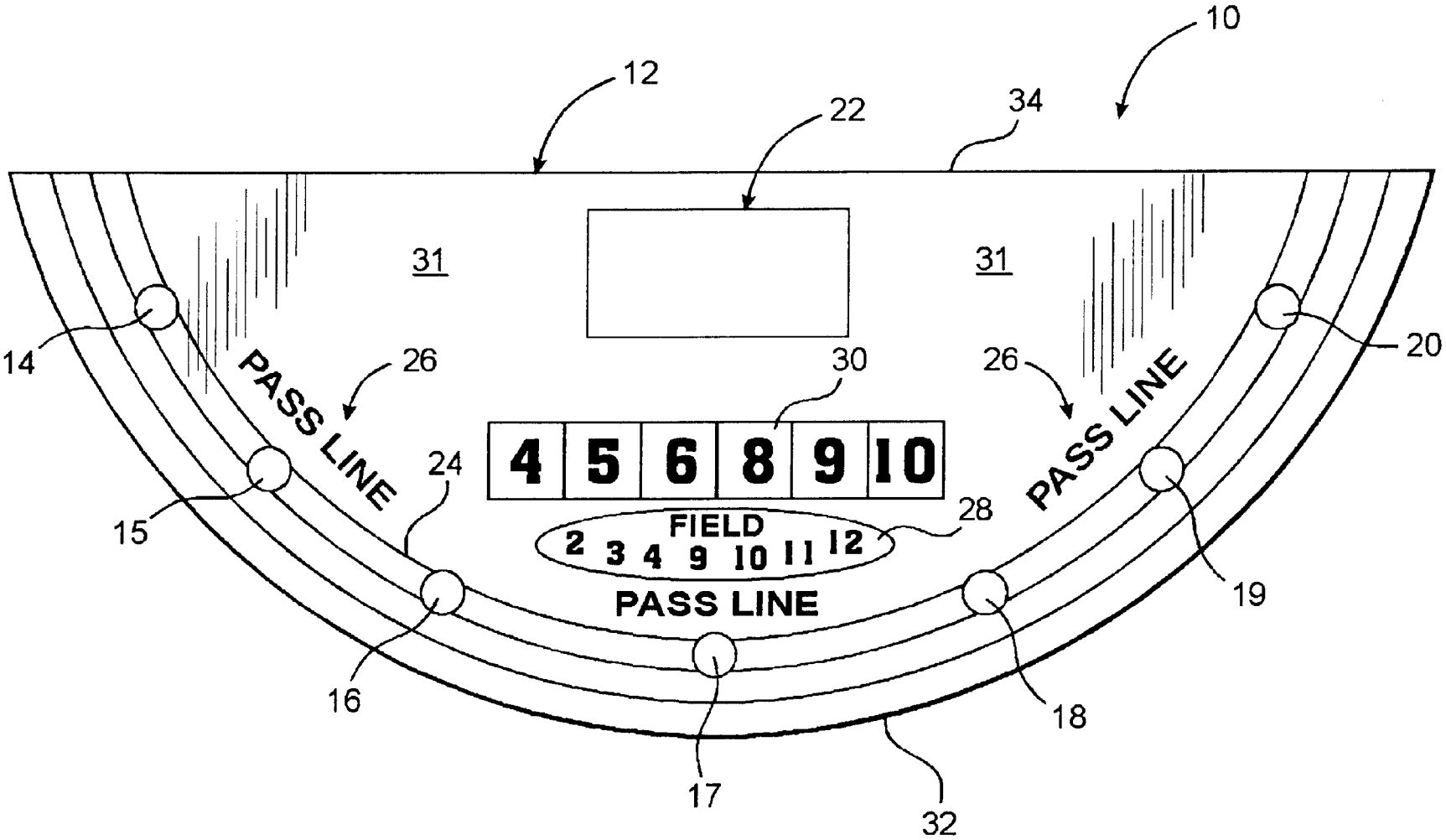
FIG. 1 is a schematic representation of a gaming assembly including a playing surface modified and adapted for the play of the modified game of the present invention.

The present invention is directed to a modified, casino type game and its method of play which combine certain preferred features associated with the card game of 21 or "blackjack" and the dice game of craps in a unique and novel fashion. In accordance with the accompanying Figures, the game and method of play of the present invention incorporate a gaming assembly which in part is generally indicated as 10 in FIGS. 1 and 2 and includes an exposed playing surface 12.

Looking first to the preferred method of play of the game of the present invention, it preferably begins with each participating player placing an initial wager so as to entitle them to participate in at least a first game stage. In the preferred embodiment, to be described in greater detail subsequently, the initial wager is placed in a first surface segment on the playing surface 12 designated as a betting area with the visually observable indicia "pass line". The player or a dealer deals no cards at this point of play, rather one of the participating players is designated as the "shooter" and performs a first dice roll, the outcome of the dice roll defining a resulting number. If the resulting number of the first or "come out" dice roll has a resulting number within a first predetermined number grouping preferably defined by the numbers 7 or 11, all players win and are paid even money on their initial wager or "pass line" bet. However, if the come out roll results in the resulting number falling within a second predetermined number grouping of 2, 3, or 12, all players loose and the dealer collects all initial or "pass line" wagers. If the first dice roll determines a resulting number within a third predetermined number grouping defined by the numbers 4, 5, 6, 8, 9 or 10, the "point number" will be established and the initial wager or "pass line" bet will be maintained on the playing surface as representative of each player's initial wager. The above steps in the preferred method of play of the modified game of the present invention represents what may be referred to as the first game stage, and in the preferred embodiment, if the resulting number serves to define a point number or is in the first predetermined number grouping so as to achieve an immediate payout, a second gaming stage as will be described may proceed. In the case of the point number being rolled, the player's initial wager serves as the wager in the second gaming stage. If, however, winnings have been paid out in accordance with the resulting number, the preferred embodiment permits the player to select whether to add those winnings to the bet for the second gaming stage or to withdraw those winnings and maintain the same bet. Of course, variations could be provided so as to always permit additional bets to be placed for the second gaming stage after the initial dice roll, regardless of the outcome of the initial dice roll. Also in the preferred embodiment, if the initial dice roll is within the second predetermined grouping of numbers, the entire game restarts with players being required to place new initial wagers.

The second game stage continues by a hand, comprising a first two cards, being dealt to each player as well as the dealer. The second game stage continues by substantially following the conventional rules of the card game of 21 in allowing each player to determine the final number count of his hand. In the method of the present invention, however, the player is permitted to undertake one of preferably three possible strategies so as to achieve the final number count as close to 21 without exceeding 21. In the preferred embodiment, a first option enables the player to merely accept the number count of the first two cards as the final number count in the hopes that this will be better than the dealer's ultimate hand. A second possible strategy permits the player to accept further cards, generally in accordance with the normal rules of 21, until a desired final number count is achieved. In this regard, the player may draw as many cards as desired unless a final number count in excess of 21 is achieved and the player "busts". Lastly, the player may also elect a third optional strategy. This third optional strategy permits the player to add the resulting number achieved by the first dice roll to the number count of the first two cards so as to define the final number count. If this option is chosen, the resulting number is added to the number count of the first two cards received in the deal. However, in the preferred embodiment, the player choosing this latter option may no longer add further cards to the final number count of his hand. Preferably, the dealer is never allowed to use the resulting number of the first dice roll in determining the final number count of his/her hand. He must proceed with the substantially conventional rules of the card game of 21 in determining the final number count of the dealer's hand. This second game stage comes to a conclusion by paying winnings to all winning players holding a winning "21" hand relative to the dealer. Such winning players of the second game stage then have the option of removing their winnings or adding their winnings, plus additional amounts, if desired, to their original pass line bet. It should be noted that in the preferred embodiment, the original pass line bet, unless lost based on the first dice roll or the outcome of the second game stage cannot be removed during the first game stage or second game stage until the designated "shooter" has rolled the dice at least once following the come out roll.

Accordingly, after completion of the second game stage, a third game stage begins. In this stage, the players who still have wagers on the pass line must risk that remaining pass line wager on the outcome of at least one additional roll of the dice. Additionally, however, as the third gaming stage begins, each participating player, whether considered a winning player or a losing player relative to the second game stage, is given the opportunity of making situational bets, generally in accordance with the conventional rules of the dice game of craps. Such situational bets include point number bets, field bets, hard way number bets, come bets, don't come bets, etc. As such, at this point a the beginning the third game stage of play, all winning players of the second game stage may still have a wager on the pass line wherein losing players of the second game stage have no wagers on the pass line. After all situational bets are made by the participating players, the player designated as the "shooter" again performs one or more continuous rolls either electronically or manually in the manner set forth above. Such rolls continue until the original "point number" is made or until the resulting number of the last previous roll is a 7. During the plurality of rolls, the dealer will pay off all point number wagers as they occur. Similarly, any field wagers are paid a single time. Point number wagers are paid as many times as the resulting number of any given dice rolls results in the hitting of the "point" on which wagers exist. Actual payout amounts on placed wagers may be consistent with the conventional rules of the dice game of craps and point numbers of 4 or 10 are paid 9 to 5; point numbers of 5 or 9 are paid 7 to 5 and point numbers of 6 or 8 are paid 7 to 6. Field bets are paid even money. Once the point is made, or the player rolls a 7, the game begins again.

Looking now to the preferred structure of the gaming assembly 10, the playing surface 12 preferably includes a plurality of player positions which may vary in number but preferably includes at least 7 such player positions 14, 15, 16, 17, 18, 19 and 20. In addition, the playing surface 12 includes a dealer position 22 disposed in accessible relation to each of the player positions at a spaced distance but at a disposition which facilitates the dealing of cards, as will be explained in greater detail hereinafter. The playing surface 12 also includes at least a first surface segment 24 preferably marked with informative indicia as at 26 which, in the preferred embodiment of FIG. 1, denotes the first surface segment 24 as being the "pass line". Further, the first surface segment or pass line is configured or otherwise structured for the receipt of a plurality of initial wagers by each player, generally in the vicinity of the player positions 14–20.

The exposed playing surface 12 further includes a plurality of additional surface segments 28 and 30 respectively designated to receive and/or indicate the placement of situational bets. More specifically, in accordance with the conventional rules of the dice game of craps, situational wagers may be placed other than the initial wager which is indicated by placement on the pass line 24. Such situational wagers include "field bets" wherein a resulting number from a dice roll being 2, 3, 4, 9, 10 and 11 or 12 indicates a winning field bet. Similarly, the additional surface segment 30 represents "point number" bets wherein the resulting number of any dice roll subsequent to the first dice roll having a resulting number of 4, 5, 6, 8, 9 or 10 results in repeated payment of winnings at specified, well-accepted odds, depending upon the point number determined from the respective dice roll. It should be emphasized that other surface segments, not shown for purposes of clarity, may also be incorporated on the playing surface 12. Such additional surface segments would also be structured to indicate additional situational wager such as "hard number" bets wherein the number 4, 6, 8, 10 and 12 is equivalent to the resulting number but must be obtained by duplicate numerals appearing on each die of a dice pair. For example each die, of a dice pair must display 2, 2; 3, 3; 4, 4; 5, 5; or 6, 6; to determine a "hard number". Other surface segments may also be indicated on the playing surface 12 in conformance with additional situational bets well recognized as being consistent with the conventional rule of the dice game of craps.

As set forth above, the first game stage of the modified game of the present invention, including its method of play, includes each participating player making an initial or first wager placed on the pass line 24. The first game stage also includes the performance of a first dice roll which may be done manually or electronically. The manual performance of the dice roll involves a single, specified player being designated as the "shooter" and physically throwing a pair of dice on a roll area 31 which may surround and overlap the aforementioned first and/or additional plurality of surface segments 24, 28, 30 and 30' respectively. When the dice roll is intended to be manually performed, retaining walls 32 and 34 are disposed in surrounding relation to front and rear peripheral portions of the playing surface 12.

Figure 2:
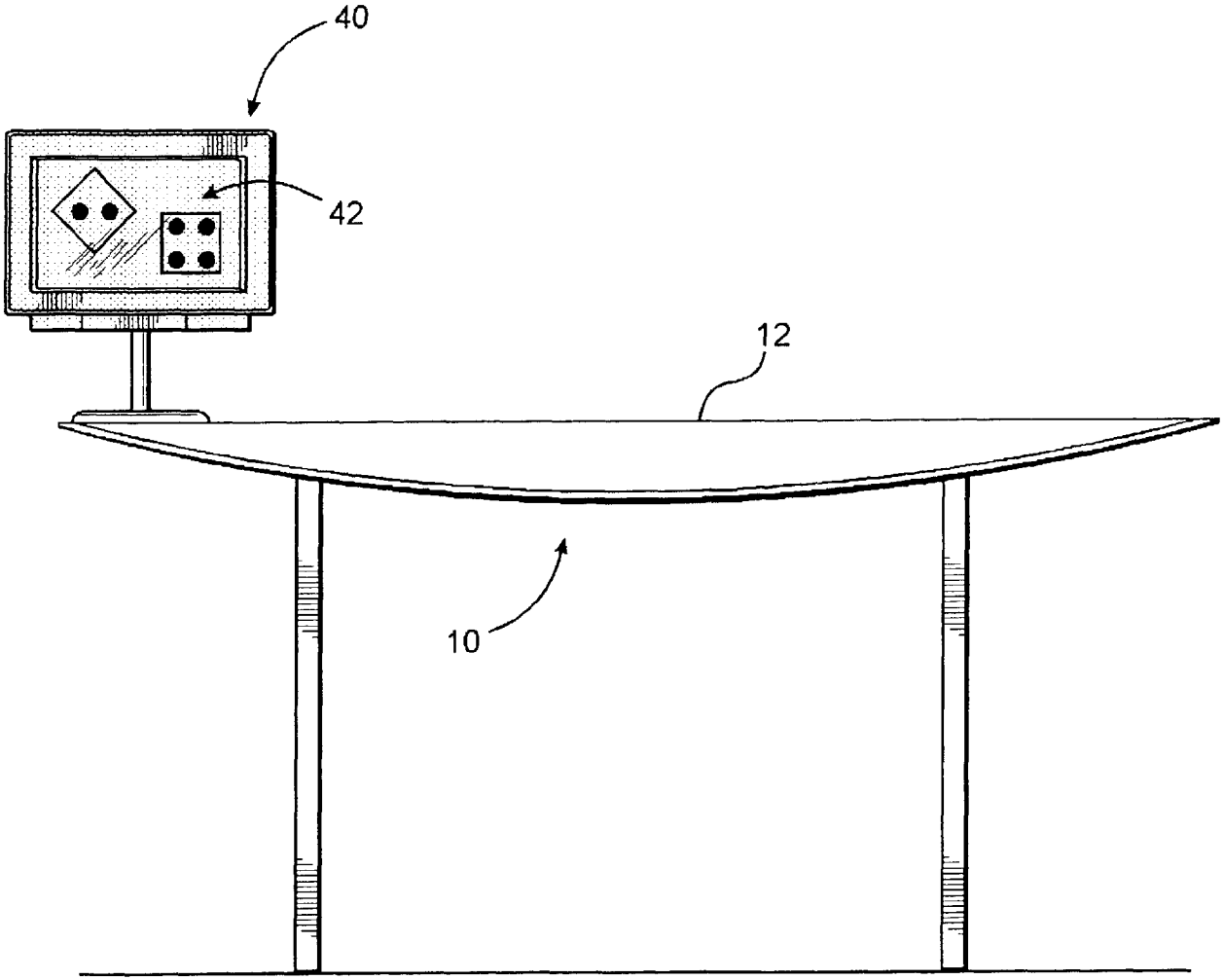
FIG. 2 is a schematic representation of a portion of the gaming assembly as shown in FIG. 1 with the addition of an electronically activated video display assembly incorporated therein.
Figure 3:
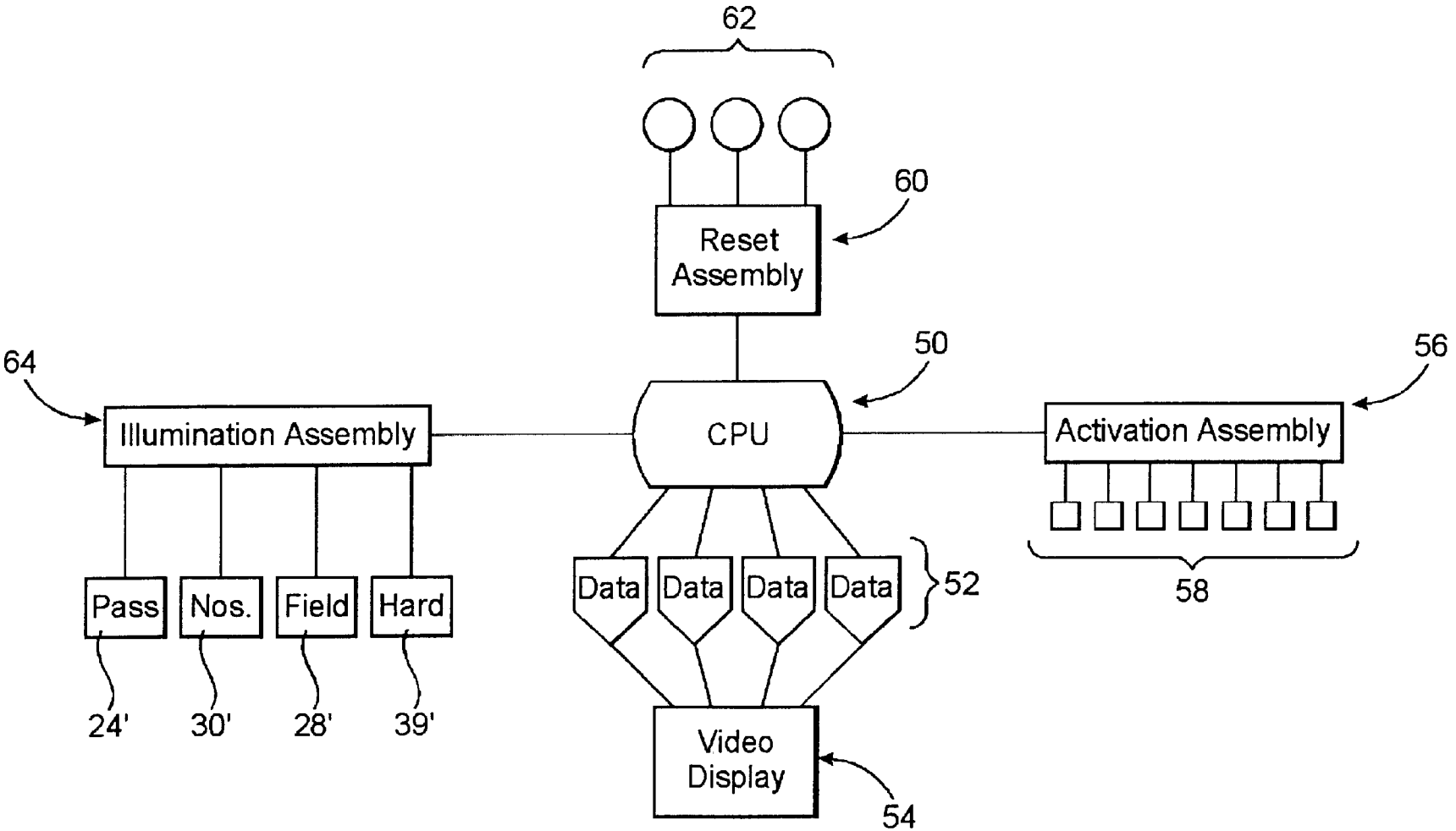
FIG. 3 is a schematic representation in block diagram form associated with the method of play of the modified game of the present invention.

With reference to FIGS. 2 and 3, the preferred embodiment includes the first game stage as well as the third game stage being played using electronic technology which, as shown in FIG. 2, includes one or more video monitors as at 40 mounted on or adjacent to the playing surface 12 and disposed in an observable position relative to each of the plurality of participating players, their respective player positions 14–20 and the dealer and dealer position 22. FIG. 3 is a schematic representation of the electronic technology involved and utilized in the electronic play of the method of the modified game. The electronic technology is particularly involved with the initial dice roll of the first game stage and the playing of the third game stage which, as set forth above, are played substantially in compliance with the conventional rules of the dice game of craps. It should be emphasized, however, that the facilities schematically represented in FIG. 3 are not intended to limit the method of playing the modified game of the present invention as being restricted to only playing a portion of the first game stage and/or the third game stage. It is further to be emphasized that modifications of the facilities of the subject gaming assembly as outlined above could be further modified to practice the method of play either entirely electronically or alternately, entirely manually, with the playing surface being integrated into a computer display.

Again with reference to FIG. 3, the facilities further defining the gaming assembly of this embodiment of the present invention includes a central processing unit as at 50 including a database assembly collectively indicated as 52. The database assembly 52 comprises at least one database, with an input by means of preprogrammed software technology specifically individualized to be capable of electronically conducting certain method steps consistent with the conventional rules of the dice game of craps. Accordingly, the software portion of the subject gaming assembly represented by the facilities of FIG. 3 and specifically by the database assembly 52 must be specifically designed for the tracking of the basic game of craps as outlined herein. A video display facility is generally indicated as 54 and is meant to include one or more video monitors 40 as shown in FIG. 2. The combined structural and technological features of the central processing unit 50, including the database assembly 52 and the video display assembly 54, being responsive to activation of the central processing unit 50, allows at least for the electronic replication of a plurality of dice rolls. Each dice roll is depicted as a pair of dice 42 generally indicated on the screen of the monitor 40. Additional graphics may be included in the individualized software portion of the central processing unit or collective database assembly 52 to incorporate graphics designed to add excitement, flare and enhance the overall attractive nature and excitement of the subject game and its method of play.

The facilities of the subject game assembly further preferably include an activation assembly generally indicated as 56 which comprises a plurality of activation members collectively indicated as 58 in the form of a plurality of "roll" buttons. Each of the roll buttons are placed at an accessible location at different ones of the plurality of player positions 14–20. When a "shooter" player is designated, such player hits or activates a corresponding or respective one of the roll buttons 58 located at the respective player position. The activation assembly serves to then activate the central processing unit 50 through the response of the database assembly 52, such as when a first roll or successive dice roll is electronically performed. After each such dice roll, a dealer has the ability to "reset" the central processing unit for receipt and response of the next command, by means of a reset assembly generally indicated as 60. The reset assembly 60 includes one or more reset buttons collectively indicated as 62. By way of example, after the first dice roll has been performed, the dealer may activate one of the appropriate reset buttons 62, wherein the reset assembly serves to inform the central processing unit that the first dice roll has been completed and the information, specifically in terms of a resulting number has been determined and "registered" by each player and/or the dealer. The next or subsequent command received from the activation assembly 56 will then "inform" the central processing unit, through cooperation with the database assembly 52, that the next and/or subsequent dice rolls are meant to determine the resulting number in one of a first, second or third predetermined number grouping. The appropriate database or data segment of the database assembly 52 will be accessed for operative depiction of the appropriate dice roll and resulting number on the video display assembly 54 generally and the one or more video monitors 40 specifically. Of course, the programming could be integrated with all necessary variations so as to eliminate the constant need for dealer reset or manipulation. Another feature of the present invention includes the provision of an illumination assembly generally indicated as 64 which is responsive to the central processing unit and depending upon the resulting number evidenced and determined by any given dice roll, electronically performed, will serve to illuminate the first surface segment 24 and/or the additional, appropriate ones of the plurality of surface segments 28, 30, etc. Somewhat conventional lighting structure may be connected to or mounted on the playing surface 12. Such conventional illumination is represented in FIG. 3 as indicating various ones of the surface segment and are appropriately numbered as 24', 28', 30', etc. Provision is also made for the illumination of other situational bets such as hard numbers and being indicated as 39. The illumination assembly 64 is directly responsive to the central processing unit 50 so as to initiate the selective illumination of the various surface segments dependent upon the particular situations indicating a winning or determinative dice roll.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A method of playing a casino type game including at least one deck of cards and at least one pair of dice, said method comprising the steps of:

a) each player making an initial wager to participate in at least a first game stage, b) continuing the first game stage by performing a first dice roll and determining a resulting number therefrom, c) playing a second game stage subsequent to the first dice roll by dealing all players and a dealer a hand of cards comprising a first two cards, d) determining a final number count of each player's hand subsequent to the dealing of cards to all the players and the dealer, said step of determining the final number of count of each player's hand including permitting the players to add the resulting number achieved by the first dice roll to a number count of the first two cards so as to define said final number count, e) determining a final number count of a dealer's hand subsequent to determining the final number count of each of the player's hands and comparing the final number count of the dealer's hand with the final number count of the player's hands so as to determine winning players and losing players of the second game stage substantially in accordance with pre-established rules of the card game 21, f) playing a third game stage subsequent to determining the winning and losing players substantially in accordance with pre-established rules of the dice game craps utilizing said first dice roll from said first game stage, and including the steps of permitting all players to make any of a plurality of pre-established situation wagers and performing additional dice rolls as necessary in accordance with pre-established rules of the dice game craps.

2. A method as in claim 1 comprising continuously repeating play of the first game stage until the resulting number is not within a first predetermined group of numbers, before playing the second game stage.

3. A method as in claim 2 further comprising collecting the initial wagers of all players participating in the first game stage when the resulting number from a respective first dice roll is within the first predetermined grouping of numbers.

4. A method as in claim 3 further comprising paying winnings to all players in accord with their respective initial wagers when the resulting number is within a second predetermined grouping of numbers and proceeding with the playing of the second game stage.

5. A method as in claim 4 further comprising adding the winnings of each player to the player's initial wager and proceeding with the playing of the second game stage.

6. A method as in claim 4 further comprising allowing the winnings of each player to be removed while requiring the maintaining of the initial wager of each player.

7. A method as in claim 4 further comprising allowing all players to maintain their initial wagers when the resulting number is within a third predetermined grouping of numbers and proceeding the playing of the second game stage.

8. A method as in claim 7 wherein the step of determining the final number count of each player's hand includes providing each player an opportunity of staying with the number count of the player's first two cards.

9. A method as in claim 8 wherein the step of determining the final number count of each player's hand includes adding the resulting number to the number count of the player's first two cards and prohibiting the player from increasing the final number count thereafter.

10. A method as in claim 9 wherein the step of determining the final number count of each player's hand includes providing each player an opportunity of taking one or more additional cards until the player's final number count equals or exceeds 21.

11. A method as in claim 1 wherein said first dice roll is accomplished manually by one player rolling a pair of dice on a playing surface.

12. A method as in claim 1 wherein said first dice roll is accomplished electronically and the resulting number is visually displayed on a video facility.

13. A method as in claim 1 further comprising paying additional winnings to all winning players of the second game stage and collecting all outstanding wagers of all losing players of the second game stage.

14. A method as in claim 13 further comprising allowing each winning player of the second game stage to add the additional winnings to the initial wager that is maintained for continued play.

15. A method as in claim 1 wherein the step of determining the final number count of each player's hand includes the step of permitting the player to undertake one of three possible strategies so as to achieve the final number count as close to 21 without exceeding 21, said three possible strategies comprising:

(i) accepting the number count of the first two cards as said final number count;

(ii) adding the resulting number achieved by the first dice roll to said number count of the first two cards so as to define said final number count; and (iii)receiving one or more additional cards from the dealer so as to define said final number count.

16. A method of playing a casino game including at least one deck of cards and at least one pair of dice, said method comprising the steps of:

a) each player making an initial wager to participate in at least a first game stage, b) performing a dice roll as part of the first game stage and determining a resulting number therefrom, c) continuing play of a second game stage subsequent to the first dice roll by dealing all players and a dealer a hand of cards comprising a first two cards, d) determining a final number count of each player's hand subsequent to the dealing of cards to all the players and the dealer, said step of determining the final number count of each player's hand including permitting the players to undertake one of at least two possible strategies to achieve the final number count, said two possible strategies comprising:

i) adding the resulting number achieved by the first dice roll to said number count of the first two cards so as to define said final number count; and ii) receiving one or more additional cards from the dealer so as to define said final number count, e) determining a final number count of the dealer's hand subsequent to determining the final number count of each of the player's hands and comparing the final number count of the dealer's hand with the final number count of the player's hands so as to determine winning players and loosing players of the second game stage substantially in accordance with pre-established rules of the card game 21, f) playing a third game stage substantially to determine the winning and losing players substantially in accordance with pre-established rules of the dice game craps utilizing said first dice roll from said first game stage.

* * * * *